US006557233B1

(12) United States Patent
Rösch

(10) Patent No.: US 6,557,233 B1
(45) Date of Patent: May 6, 2003

(54) METHOD AND INTERMEDIATE PRODUCT FOR PRODUCING A HOLLOW BODY AND A HOLLOW BODY PRODUCED BY SAID METHOD

(75) Inventor: Fritz Rösch, Schwabach (DE)

(73) Assignee: Alcan International Limited (CA)

( * ) Notice: Subject to any disclaimer, the term of this patent is extended or adjusted under 35 U.S.C. 154(b) by 0 days.

(21) Appl. No.: 09/831,059

(22) PCT Filed: Oct. 19, 1999

(86) PCT No.: PCT/EP99/07896

§ 371 (c)(1),
(2), (4) Date: Jul. 9, 2001

(87) PCT Pub. No.: WO00/27555

PCT Pub. Date: May 18, 2000

(30) Foreign Application Priority Data

Nov. 6, 1998 (DE) ..... 198 51 259

(51) Int. Cl.[7] ..... B21D 26/02
(52) U.S. Cl. ..... 29/421.1; 72/370.22
(58) Field of Search ..... 72/61, 367.1, 370.06, 72/370.2, 370.22, 370.21, 379.2; 29/421.1; 228/157

(56) References Cited

U.S. PATENT DOCUMENTS

| | | | | |
|---|---|---|---|---|
| 2,503,190 A | * | 4/1950 | Branson | 29/421.1 |
| 2,641,830 A | | 6/1953 | Lamb et al. | |
| 2,734,473 A | * | 2/1956 | Reynolds | 29/421.1 |
| 4,588,651 A | | 5/1986 | Israeli | |

FOREIGN PATENT DOCUMENTS

| | | |
|---|---|---|
| DE | AS1207782 | 5/1964 |
| DE | PS1170764 | 2/1965 |
| DE | 4232161 | 3/1994 |
| DE | 19531035 | 2/1997 |
| EP | 0581458 | 2/1994 |
| JP | 05329530 | 12/1993 |
| JP | 08168814 | 2/1996 |
| WO | WO9200190 | 1/1992 |

OTHER PUBLICATIONS

Abstract if Japanese Patent Publication No. JP 08168814, Patent Abstracts of Japan, published Feb. 7, 1996.
J.R. Davis, *Aluminum and Aluminum Alloys*, ASM Specialty Handbook, The Materials Information Society, 1993, p. 245.
Abstract of Japanese Patent Publication No. JP 05329530, Patent Abstract of Japan, published Dec. 14, 1993.
Abstract of German Patent Publication No. DE 19531035, European Patent Office Website (esp@cenet), Jul. 24, 2001.

* cited by examiner

*Primary Examiner*—Lowell A. Larson
(74) *Attorney, Agent, or Firm*—Cooper & Dunham LLP

(57) ABSTRACT

The invention relates to method for producing a hollow body (26) from sheet metal, especially from aluminum or aluminum alloys. According to the inventive method, a substantially flat sheet metal blank (4) is provided. At least one wall intermediate element (8) which is produced as one piece with the sheet metal blank (4) is folded and/or bent into several substantially superimposed layers. Marginal areas (16, 18) of the sheet metal blank (4) are placed closely side by side, preferably they are placed on top of one another in such a manner that they overlap to some degree, and they are connected to one another. The sheet metal blank (4) and the folded wall intermediate element (8) are subjected to a hydraulic or pneumatic internal high pressure so that the folded wall intermediate element (8) is freely unfolded to form the hollow body (26). The invention also relates to a hollow body (26) produced by said method and to an intermediate product (2) which can be used to produce such a hollow body (26) according to the inventive method.

20 Claims, 3 Drawing Sheets

METHOD AND INTERMEDIATE PRODUCT FOR PRODUCING A HOLLOW BODY AND A HOLLOW BODY PRODUCED BY SAID METHOD

FIELD OF THE INVENTION

The present invention relates to a method for producing a hollow body from sheet metal, especially from aluminum or alloys thereof. Known as one such method for producing a hollow body is, for example, the internal high-pressure forming method wherein the workpiece to be formed is inserted in a die suitable for forming and subsequently a liquid or gaseous, i.e. fluid, pressure medium introduced into the die such that it causes the workpiece in the die to be formed by the pressure of the fluid medium, whereby the workpiece is able to conform to the inner wall of the die.

Furthermore, the present invention relates to a hollow body produced by one such method as well as to an intermediate product as may be used for producing one such hollow body by the method in accordance with the invention.

PRIOR ART

Methods of producing so-called tubular or channel plates, i.e. plates including tubes or coiled tubing, are known in which two flat sheets of aluminum or alloys thereof located one on the other are fixedly joined to each other and the sheet metal portions located inbetween, and not joined to each other, are bulged in a die by introducing a pressure medium to form the channels between the plates. Also known are methods for forming single-ply plates in a die by subjecting them to the pressure of a pressure fluid at one end and stretching them into the cavity of the die (EP-A-0 581 458 and AST Speciality Handbook, Aluminum and Aluminum Alloys, The Materials Information Society, 1993, page 245). These known methods and not always satisfactory, especially when workpieces need to be subjected to a relatively strong change in shape, for example, in cases in which the tubular bodies or extruded sections need to be strongly dilated, particularly where aluminum or alloys thereof are concerned which do not permit forming as good as steel. However, even in the case of steel, strongly forming workpieces fails to be satisfactory with the methods as known.

To increase the inner cross-sections of a workpiece it is known from DE-A-42 32 161 to produce a hollow body in making use of a basic body produced of blanks, welded to each other at the edges, by the combined application of internal high pressure forming and deep drawing. Due to this making it necessary to combine two methods, producing the hollow body is comparitively complicated for one thing. For another, the production means needed for this purpose is extremely complicated and expensive. Furthermore, it is practically not possible to produce very large tanks of aluminum or alloys thereof, such as tanks for motor vehicles, aircraft or ships, due to the insufficient deformation capacity of the aluminum material.

One method of achieving enhanced forming of workpieces of aluminum or an alloy thereof is described in DE-A-195 31 035 in which several flat sheet metal blanks of aluminum or an alloy thereof are abutted edgewise and joined by spot welding into the workpiece to be formed. In this arrangement, individual flat sheet metal blanks are inserted in the workpiece for increasing the volume of the hollow body to be later produced from the workpiece. Subsequently, the workpiece thus configured for forming is inserted in a die and expanded outwards and deformed by the effect of heated oil introduced therein in achieving the hollow body by internal high pressure forming. In this arrangement the joined sheet metal blanks conform to the inner contour of the die by applied internal pressure. However, there are limits to the degree to which the hollow body volume can be expanded as dictated, for one thing, by the stress limit of the solder joints between the individual sheet metal blanks and, for another, the material already expanded becomes consolidated in the region of sharp-edged cross-section transitions of the die due to the extreme deflection of the material in these areas. The increasing strain on the material associated with the increase in strength harbors the risk of cracks occurring, this being the reason why a minimum critical bending radius must not be violated. This is why no acute forming in the corner portions is achievable. Although it is possible with this method to obtain a strong forming of the workpiece in the die in producing a large volume hollow body, however, there are also limits here too, to the size and shape of the hollow body volume to be produced. More particularly, it is not possible with this known method to produce minute forming radii, near to being sharp-edged, and also large hollow bodies in one piece and without flanges extending over the full contour.

SUMMARY OF THE INVENTION

In view of these drawbacks and the problems remaining in methods known from prior art, the invention is based on the objective of providing a method and an intermediate product for producing a hollow body of sheet metal, more particularly of aluminum or alloys thereof, which permits with minimum complication configuring a large hollow body volume corresponding to the space available in the fitted condition (for example as in tanks for motor vehicles in the rear axle area thereof) whilst simultaneously achieving very small forming radii and very large forming depths.

In accordance therewith, first a substantially flat sheet metal blank, more particularly of aluminum or an alloy thereof, is provided as the workpiece, although in general any metal material having a suitable forming capacity may be employed as the workpiece material, i.e. light metals through non-alloyed and alloyed hardened steels up to tempered and stainless steels. In this providing step of the method it is possible to determine the shape and size of the sheet metal blank, and by suitably selecting the dimensions of the sheet metal blank to already influence the desired final outer contour of the hollow body to be produced. Working the sheet metal blank is done preferably by known ways and means mechanically by cutting or thermally by flame and laser cutting.

The suitably blanked sheet metal is then folded and/or bent in a subsequent forming process in the region of a wall intermediate element configured integrally with the sheet metal blank. In this arrangement the wall intermediate element forms a section or partial area of the sheet metal blank, i.e. the wall intermediate element is integrated in the sheet metal blank. This internal configuration greatly facilitates handling the sheet metal blank as well as folding and/or bending. Furthermore, this enables the productivity and accuracy of the sheet metal blank to be enhanced, since particularly unlike the method as it reads from DE-A-195 31 035 no individual formed parts need to be soldered together. The hollow bodies to be produced by the method in accordance with the invention in the internal high pressure forming method can thus replace joined, e.g. soldered, welded or beaded constructions of individual sheet metal blanks in avoiding the problems associated with leakage or dynamic fracture in the jointing zone and assuring improved strength properties.

Bending may be done in this step of the method, for example, by roll forming, providing greater freedom for configuration as regards shaping the wall intermediate element. In this arrangement it is also possible to achieve a very sharp-edged bending of the sheet metal in the region of the wall intermediate element in thus making folding possible in several plies, located substantially superimposed. Accordingly, the individual sheet metal plies may be folded, for example, two-ply, three-ply or multi-ply one on the other.

In the case of folding and/or bending the wall intermediate element, it is furthermore possible to relate positioning the edge portions of the sheet metal blank to facilitate subsequent joining thereof. For joining, the edge portions of the sheet metal blank are abutted, preferably with a certain overlap, and joined together, for example, by soldering, welding, such as e.g. mash seam welding or laser beam welding, or also by edging, preferably along the longitudinal extension of the edges of the sheet metal blanks. This step in the method results in a flat hollow body having a closed cross-sectional shape which, by the joining at the edges, is substantially pressure-tight and thus ready for forming in the subsequent internal high-pressure forming step.

In the course of the internal high-pressure forming step a hydraulic or pneumatic pressure medium is introduced into a cavity, defined by the sheet metal blank and the at least one folded wall intermediate element, through a suitable connector, for example, by piping or sockets sealingly joined (e.g. by soldering) in the sheet metal blank or wall intermediate element. By means of the pressure medium the sheet metal blank and the folded wall intermediate element are subsequently subjected to an internal high pressure, as a result of which the multi-ply folded wall intermediate element freely unfolds to its full length in forming the hollow body. Thus, freely shaping the hollow body is achieved in accordance with the invention by unfolding of the wall intermediate element without the workpiece being exposed to any appreciable material strain. Unlike prior art methods the desired shape is not defined by the geometry of the tooling involved in the internal high-pressure forming method, e.g. the die, but by the shape and size of the sheet metal blank and/or wall intermediate element made available at the start of the method.

The gist of the invention is thus to provide a primary increase in volume of the hollow body by unfolding the multi-ply configured wall intermediate element to its extended length without, however, causing any substantial strain in the material. This achieves the major advantage of the full strain capacity of the material still being available for additional localized deepenings due to stretching or deep drawing in subsequent hydroforming, where needed. Due to the method in accordance with the invention, especially when employing materials such as aluminum having a low deformation capacity, stress peaks in the material are avoided so that a hollow body having small forming radii and large forming depths can be configured. Accordingly, the method in accordance with the invention is particularly suitable for producing workpieces produced by lightweight structures thus necessitating the use of the specifically lighter material aluminum, as in the case of e.g.tanks for motor vehicles, aircraft, ships or the like.

The gist of the present invention is likewise based on providing a method and an intermediate product for producing a hollow body which ensures configurations of more complex geometry, higher forming accuracy and strength properties for a reduced workpiece mass in a hollow body.

To achieve the desired final contour of the hollow body to be produced, the unfolding wall intermediate element and/or the sheet metal blank are preferably formed at least sectionwise after being unfolded by an increased internal pressure in the stretching or deep drawing process, for example, by placing the workpiece in a suitable die. Since the sheet metal blank with the wall intermediate element is first merely unfolded by the applied hydraulic or pneumatic internal pressure, and not deep drawn or stretched, the method in accordance with the invention now makes it possible to form the hollow body in a second forming process precisely to the desired shape by internal high pressure. Contrary to prior art forming methods, in which there are limits to shaping the workpiece especially due to the limited forming capacity of the material, these limits are now eliminated by stretching or deep drawing in a step separate from the unfolding of the hollow body, so that in this second forming step even workpieces of complex geometry can be produced. The desired larger volumes of the tanks are thus achieved by the folded sheet metal sections of the wall intermediate element which are first unfolded and then, where necessary, fully or partly stretched or deep drawn.

For shaping the hollow body to be produced, preferably at least one upper and one lower sheet metal section of the blank are inserted superimposed during folding and/or bending. In this arrangement, the sheet metal sections are arranged superimposed preferably in parallel and substantially coplanar, resulting in a substantially closed cross-sectional shape of a flat hollow body. This greatly facilitates subsequent overlapping and joining the edge portions of the sheet metal blank.

To close and seal the workpiece before unfolding by application of the internal high pressure, it is good practice to join the superimposed sheet metal sections at least sectionwise at their faces, e.g. by soldering or welding. In this arrangement the faces of the sheet metal sections of the blank are preferably pressed together so that the individual plies of the folded wall intermediate element abut to advantageously permit joining, e.g. by soldering or welding the faces of the plies of the wall intermediate element to each other and to the faces of the adjoining sheet metal sections.

When the multi-ply arrangement of the wall intermediate element results in an opening between the upper and lower sheet metal section, to facilitate attaining a closed cavity, it is preferred to provide a spacer, such as e.g. of sheet metal, between the superimposed faces of the sheet metal sections in the region of the opening. This enables a spacing or clearance having materialized by the side folding of the multi-ply arrangement wall intermediate element between the sheet metal sections to be bridged and filled to advantage to ensure reliable closure of the cavity.

For face closing the cavity it is furthermore good practice to configure at least one tab-like section at the edge of the upper or lower sheet metal section. After the sheet metal section his been folded or bent into the desired shape, this tab section is folded over at the face of the lower or upper sheet metal section and joining thereto, e.g. by soldering, this too ensuring a tight closure of the faces of the workpiece.

For simple geometry shaping with a cuboidal or rectangular contour, it is preferred to provide the flat sheet metal blank within the scope of step a) of the method with a substantially rectangular flat shape which, on the one hand, is simple to produce whilst ensuring, on the other, facilitated folding or bending of the sheet metal blank. However, other flat shapes of the sheet metal blank are just as possible, such as e.g. round, oval, square or polygonal. Furthermore, appendages or sections protruding outwards beyond the e.g. rectangular flat shape may be configured which to advantage in the scope of step b) of the method are folded inwards in providing the desired unfolding sheet metal sections for a large cavity volume when later unfolded. This configuration of the flat sheet metal blank in various shapes and sizes ensures diversified shaping for the hollow body to be produced.

In pre-forming or forming the hollow body to its final contour, it is good practice when the folded sheet metal blank is inserted into a closable die before or after the unfolding process which, to facilitate inserting the folded sheet metal blank and removal of the formed hollow body, is sectioned and its die cavity preferably corresponding to the desired outer contour of the hollow body to be produced. By flooding the workpiece with a pressure fluid the workpiece receives a high pressure from within and is simultaneously formed to the inner contour of the die simultaneously or after unfolding of the multi-ply configured wall intermediate element. The die ensures additional stability of the workpiece during forming, so that by means of this method even workpieces difficult to form, such as e.g. of aluminum or alloys thereof can now be subjected to strong forming with no problem.

For subjecting the sheet metal blank to a hydraulic or pneumatic internal high pressure, it is good practice to employ as the pressure fluid an oil having ambient temperature or heated oil. In general, however, any other suitable pressure fluid, e.g. water, emulsion, compressed air or the like may be employed for internal high-pressure forming. Using oil, as compared to gases, offers, however, the advantages of it being incompressible and having a substantially higher thermal capacity so that the workpiece can be subjected to stronger forming. In addition, making use of oil avoids the danger of an explosion as could be the case when employing gas mixtures. Using oil, as compared to gases, thus offers substantial advantages as regards a more facilitated handling of the pressure medium. Heating the oil used as the pressure medium, preferably to a temperature of at least 150° C., offers furthermore the advantage that during hydroforming of the workpiece to be formed, heat is supplied to a sufficient degree, whereby, especially in forming hollow bodies of aluminum or alloys thereof, a high deformation capacity is retained even when strongly forming into large-volume hollow bodies.

In accordance with a further aspect, the present invention relates to a hollow body comprising at least one wall intermediate element unfolding by an internal high pressure. This hollow body features the advantages already cited in describing the method in accordance with the invention, such as sharp-edged contours, small forming radii and large forming depths for a large hollow body volume and high strength due to production from a single sheet metal blank.

For configuring a stable hollow body having good strength properties, it is preferred that it comprises a substantially axially or rotationally symmetrical shape, permitting, for example, the production of cuboidal, but also oval or polygonal hollow bodies. Configuring such axially symmetrical bodies materializes to advantage by arranging an even number of, for example two, wall intermediate elements in the workpiece to be formed.

To optimally adapt the hollow body volume to the space available in the installed condition, it is of advantage in certain applications when the hollow body comprises a shape dilated substantially partially in one or more planes and directions. In this arrangement the hollow body may assume for example, a conical shape. Achieving this shape is simple, by arranging only one wall intermediate element in the workpiece to be formed.

As evident from that said above, the intermediate product in accordance with the invention for producing a hollow body of sheet metal, more particularly of aluminum or an alloy thereof, comprises a sheet metal blank as well as at least one wall intermediate element configured integrally with the sheet metal blank, and folding and/or bending into several plies located substantially superimposed, results in a sandwich-type structure for the wall intermediate element. Furthermore, edge portions of the sheet metal blank are joined to each other e.g. by soldering, welding, beading or the like so that an intermediate product having a closed cross-sectional contour in the form of a plane hollow body materializes. The wall intermediate element(s) is/are configured such that unfolding full-length is possible at least sectionwise. As a result of this, as described above, due to the folded wall intermediate elements, the desired volume dilation can occur substantially without material strain, in thus enabling the volume of the hollow body to be produced to be effectively increased, whilst retaining the full strain capacity of the material. Furthermore, the integral configuration of the wall intermediate element in the sheet metal blank ensures facilitated handling since there is no need to compose several individual sheet metal blanks at high expense and labor. In addition, jointing zones are avoided, as a result of which, the strength of the workpiece is increased.

To facilitate production of the intermediate product, it is good practice when this comprises at least one upper and one lower sheet metal section, arranged substantially superimposed. This simplifies joining and sealing the edge portions of the intermediate product as is necessary for effectively applying an internal high pressure for an internal high-pressure forming operation.

In certain applications, it is good practice when a fold of the wall intermediate element extends into a portion between the upper and the lower sheet metal section. With such a configuration it is possible, as already mentioned, to press the wall intermediate element by internal high pressure, as viewed in the cross-section of the intermediate product from the interior of the cavity, configured by the intermediate product, outwards and to unfold and stretch without material strain. In this arrangement, the wall intermediate element may be arranged folded, for example two, three or multi-ply between the two sheet metal sections.

As an alternative, it is good practice for uniform dilation of the intermediate product when at least one fold of the wall intermediate element is configured to protrude outwards beyond the remaining folds of the wall intermediate element, i.e. comprising a differing length. In this arrangement, it is mainly the upper and the lower sheet metal section that is subjected to pressure in the internal high-pressure forming method so that the wall intermediate element, as viewed cross-sectionally, moves from outwards inwardly and is thereby folded open into a wall section of the resulting hollow body.

To seal the intermediate product for later subjecting it to the internal high pressure, it is good practice when the sheet metal sections are joined at their faces at least sectionwise and/or to the faces of the wall intermediate element, to thus configure a flat hollow body closed off outwards.

It is likewise good practice for bridging an opening between the superimposed faces of the sheet metal sections, which may be provided due to the wall intermediate element arranged inbetween, to arrange a spacer which is joined to the faces of the sheet metal sections for closing off the face.

To facilitate inserting the intermediate product in a die for the internal high-pressure forming method it is furthermore good practice when the intermediate product is configured as a substantially flat hollow body.

For introducing the pressure medium into the intermediate product, it is preferred that the intermediate product comprises a blast socket or the like. The blast socket may be inserted at any desired location in the sheet metal blank or the wall intermediate element to facilitate filling the cavity surrounded by the intermediate product with the pressure medium.

BRIEF DESCRIPTION OF THE DRAWINGS

A few embodiments of the invention will now be detained as shown in the drawings in which.

DETAILED DESCRIPTION OF PREFERRED EMBODIMENTS OF THE INVENTION

Figure 1:
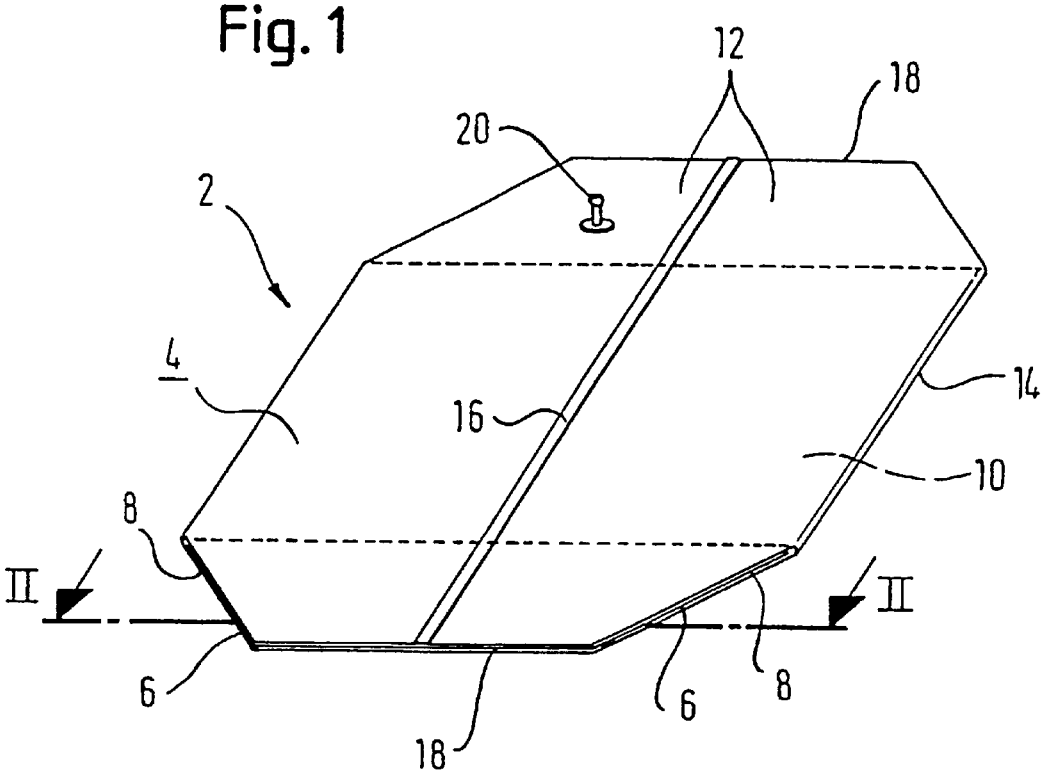
FIG. 1 is a view in perspective of a first embodiment of an intermediate product in accordance with the invention.

Referring now to FIG. 1, there is illustrated a view in perspective of the intermediate product 2 for producing a hollow body formed from a sole thin-walled sheet metal blank 4. In this arrangement, the sheet metal blank 4 in this case is made of aluminum so that the mass of the workpiece can be maintained low to provide a particularly lightweight intermediate product 2. At the inclined sides of the intermediate product 2, evident in FIG. 1 on the right and left, folds 6 in the form of a wall intermediate element 8 are arranged or folded in place. The wall intermediate elements 8 are configured integrally of a workpiece having the sheet metal blank 4, whereby the folds 6 of the wall intermediate element 8 extend into a flat cavity 10 configured by the intermediate product 2. This cavity 10 is accordingly totally surrounded and defined by the sheet metal blank 4. Furthermore, the sheet metal blank 4 comprises two upper sheet metal sections 12 located at the upper side of the intermediate product 2 and a lower sheet metal section 14 arranged at the underside. The upper sheet metal sections 12 are inserted substantially parallel to and coplanar over the lower sheet metal section 14 and thus define the cavity 10 of the intermediate product 2 in the extent of its width and length.

As furthermore evident from FIG. 1, edge portions 16 of the sheet metal blank 4 are joined to each other at the upper side of the intermediate product 2. In this arrangement, superimposed inner and outer surface areas of the upper sheet metal sections 12 are placed one on the other and soldered so that the intermediate product 2 comprises lengthwise only one soldered joint. Furthermore, the faces 18 of the intermediate product 2 shown at the front and rear end of the intermediate product 2 are pressed together so that the spacings between the individual plies of the folds 6 are located one on the other. Joining is done in this case by soldering. Soldering may be done in making use of the Nokolok solder method in a continuous oven in which sodium fluoroaluminate is employed as the flux. Accordingly, the cavity 10 surrounded by the intermediate product 2 is totally sealed off from the outside, so that the intermediate product 2 can be put to use for subsequent internal high-pressure forming. For this purpose, a blast socket 20 is arranged at the upper side of the intermediate product 2 in the cavity 10 of the intermediate product 2 for introducing a hydraulic or pneumatic pressure medium.

Figure 2:
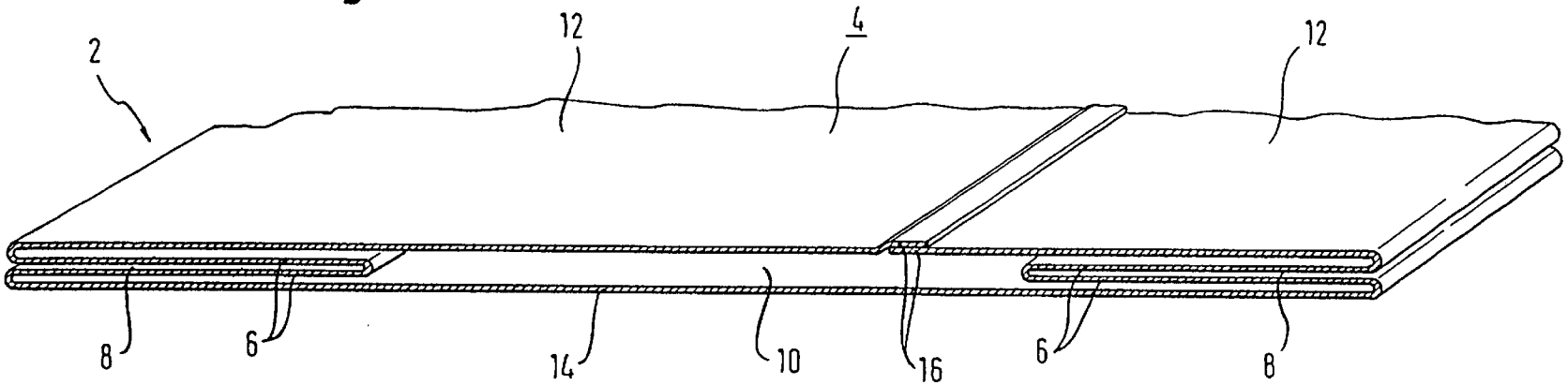
FIG. 2 is a magnified cross-sectional view of the intermediate product in accordance with the invention as taken along the line II—II as shown in FIG. 1.

Referring now to FIG. 2, there is illustrated in a magnified view in perspective cross-sectionally as taken along the line II—II as shown in FIG. 1, the folds 6 of the wall intermediate element 8 in individual plies. In accordance with this first embodiment of the intermediate product 2 in accordance with the invention the wall intermediate elements 8 are arranged mirror-symmetrical to each other between the upper and lower sheet metal sections 12, 14 of the sheet metal blank 4 and protrude into the cavity 10 of the intermediate product 2. The wall intermediate elements 8 in this case are bent two-ply and folded four-ply in the bending radius of the sheet metal blank 4 so that a flat hollow body is configured. It is furthermore clearly evident from FIG. 2 that the intermediate product 2 is formed from a sole sheet metal blank 4, whereby the edge portions 16 of the sheet metal blank 4 are joined to each other, e.g. by soldering, welding or bonding at the upper side of the formed intermediate product 2 with a certain overlap.

Figure 3:
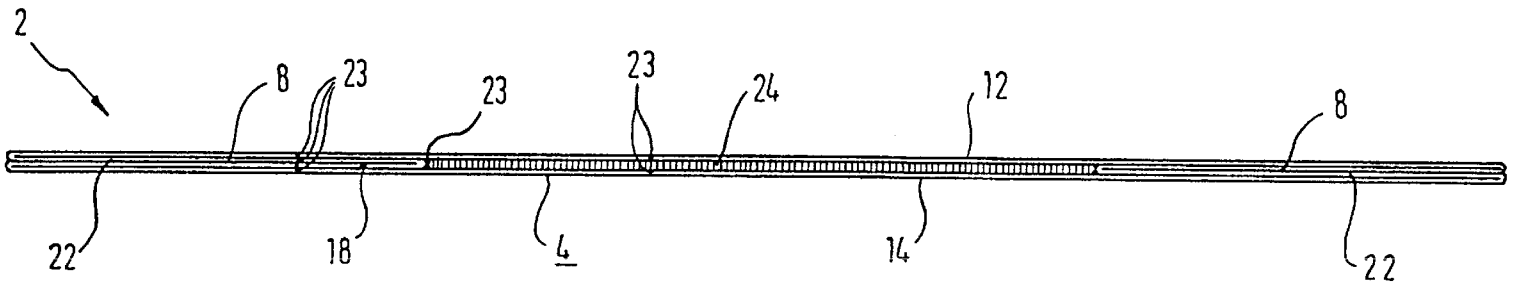
FIG. 3 is a magnified cross-sectional view of the intermediate product in accordance with the invention as taken along a face with an inserted spacer.

Referring now to FIG. 3, there is illustrated in a magnified cross-sectional view a squeezed, and in this case, soldered edge portion of a face 18 of the intermediate product 2. Due to the wall intermediate element 8 being provided in several plies between outer edge sections 22 of the intermediate product 2, an opening materializes in the middle portion of the section, which to obtain a closed cavity is sealed off by a spacer 24 of sheet metal configured in accordance with the height of the plies of the wall intermediate element 8. In this arrangement the spacer 24 is inserted in the opening and fixedly joined to the upper and lower upper sheet metal sections 12, 14 as well as to the adjoining portions of the wall intermediate element 8 at the locations 23, e.g. by soldering. The spacer 24 is preferably made of a material corresponding to that of the sheet metal blank 4, although it may also be made of any material suitable for joining the faces 18, such as e.g. an aluminum alloy, steel, galvanized sheet metal or higher strength sheet metal.

Figure 4:
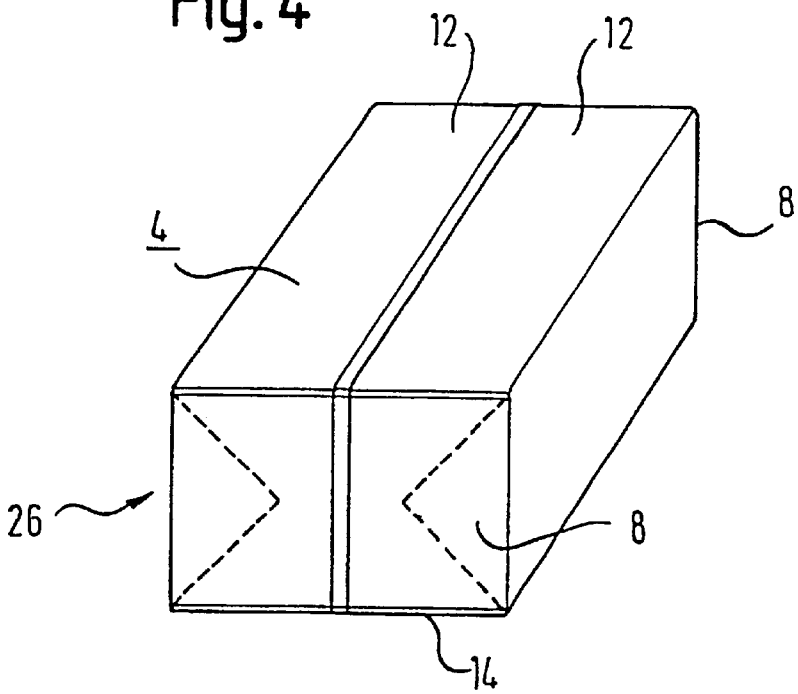
FIG. 4 is a view in perspective of a hollow body in accordance with the invention produced from the intermediate product as shown in FIG. 1.

Referring now to FIG. 4, there is illustrated how the intermediate product 2, configured by ways and means as described above, is subsequently formed, in making use of the internal high-pressure forming method, into a cuboidal hollow body 26 which may involve, for example, the basic shape for a motor vehicle tank. For internal high-pressure forming, a high pressure fluid, such as e.g. oil, is introduced via the blast socket 20, as shown in FIG. 1, into the flat cavity of the intermediate product as configured by the sheet metal blank 4 with the wall intermediate element 8. In this arrangement, the pressure medium has a pressure which is sufficiently high to move the upper and lower upper sheet metal sections 12, 14 outwards and thus away from each other, as well as to simultaneously unfold the wall intermediate element 8, i.e. to translate the bent and/or folded wall intermediate element 8 into its extended condition. This results in a substantially rectangular or cuboidal hollow body contour, since the wall intermediate element 8 simply unfolds without being deformed with material strain. For final contouring, the hollow body 26 may be inserted in a die (not shown) the die cavity of which corresponds to a desired outer contour of the hollow body. By subjecting the sheet metal blank 4 to an increased internal pressure the unfolded wall intermediate element 8 as well as the remaining workpieces, such as the upper and lower upper sheet metal sections 12, 14 can be further formed in a subsequent operation by stretching or deep drawing by known ways and means into the desired contour. As furthermore clearly evident from FIG. 4, configuring a hollow body 26 is possible from one piece, i.e. from a single sheet metal blank 4 which thus features only a very low number of jointing locations and no flanges surrounding the full contour. This results in the hollow body 26 having very good strength properties, unlike hollow bodies produced conventionally by the internal high-pressure forming method.

Figure 5:
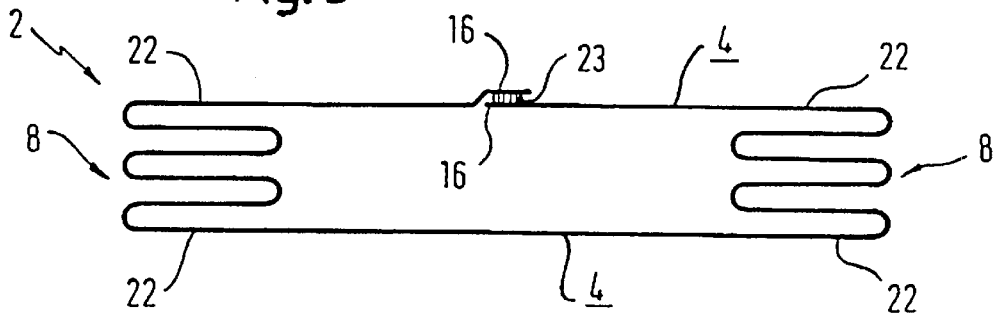
FIG. 5 is a diagrammatic cross-sectional view of a second embodiment of the intermediate product in accordance with the invention.

Referring now to FIG. 5, there is illustrated in a diagrammatic cross-sectional view a second embodiment of the intermediate product 2 in accordance with the invention. This differs from the intermediate product 2 as shown in FIG. 2 substantially by how the wall intermediate elements 8 are configured. In this case two wall intermediate elements 8 are arranged axially symmetrical relative to an axis (not shown) and each bent three-ply. In this arrangement, the individual plies in the outer edge sections 22 of the intermediate product 2 are located one on the other and permit, on being unfolded, an even larger dilation of the tank volume, contrary to the embodiment of the intermediate product 2 as shown in FIG. 2. This thus enables the size of the volume of the hollow body 26 to be produced, to be influenced by the number of plies configured in the wall intermediate element 8. Furthermore, the edge portions 16 of the sheet metal blank 4 are abutted via a solder joint 23 to form a flat hollow body.

Figure 6:
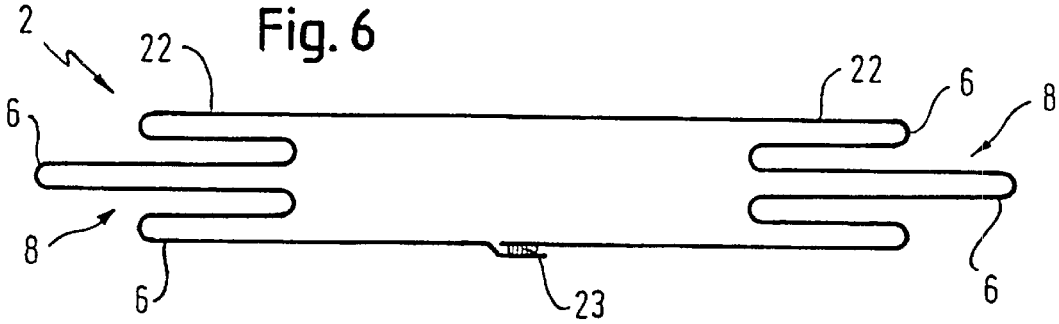
FIG. 6 is a diagrammatic cross-sectional view of a third embodiment of the intermediate product in accordance with the invention.

Referring now to FIG. 6, there is illustrated a third embodiment of the intermediate product in accordance with the invention in a diagrammatic cross-sectional view which as compared to the second embodiment as shown in FIG. 5 is configured differently as regards forming the folds 6 of the wall intermediate element 8. As evident from FIG. 6 each of the wall intermediate elements 8 comprises a fold 6 protruding beyond the outer edge sections 22 of the upper and the two lower sheet metal sections 12, 14. Accordingly, the wall intermediate elements 8 as shown in FIG. 6 comprise plies and thus also folds 6 differing in length. In unfolding the intermediate product 2, the individual folds 6 of the wall intermediate element 8 are unfolded, the long folds 6 moving from outwards inwardly in being formed into a wall part of the hollow body to be produced. It is thus the size and length of the plies or folds configured in the wall intermediate element 8 that define the size of the inner cross-section of the hollow body to be produced.

Figure 7:
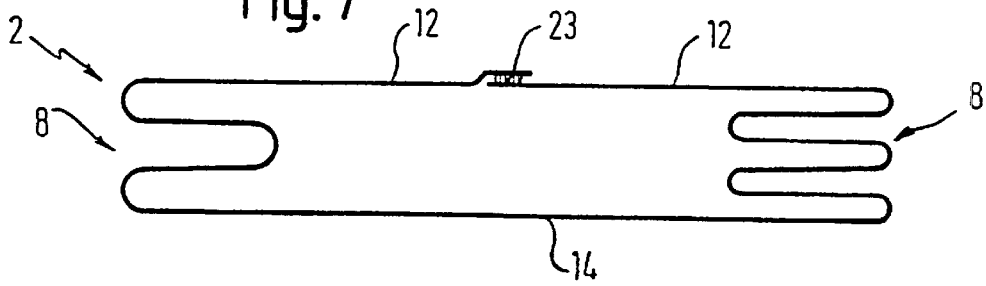
FIG. 7 is a diagrammatic cross-sectional view of a fourth embodiment of the intermediate product in accordance with the invention.

Referring now to FIG. 7, there is illustrated a fourth embodiment of the intermediate product in accordance with the invention in a diagrammatic cross-sectional view, in which, unlike the first embodiment as shown in FIG. 2, the wall intermediate elements 8 are each configured differingly. In this arrangement, the wall intermediate element 8, as shown in FIG. 7 on the right, is provided three-ply whilst the wall intermediate element 8 located between the upper 12 and lower sheet metal section 14, as shown in the drawing on the left, is configured merely two-ply. It is due to this difference in shaping the wall intermediate elements 8 that configuring a partially further unfolded hollow body shape is made possible as shown in FIG. 8.

Figure 8:
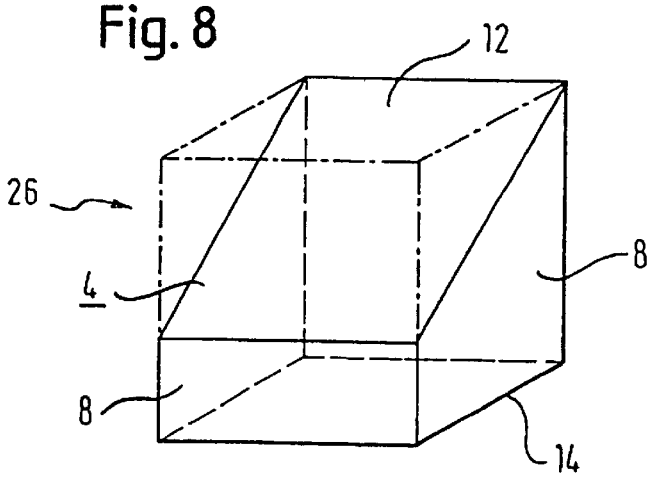
FIG. 8 is a view in perspective of a hollow body in accordance with the invention produced from the intermediate product as shown in FIG. 7.

Referring now to FIG. 8, there is illustrated diagrammatically a hollow body 26 unfolded from the intermediate product 2 as shown in FIG. 7 by the high-pressure forming method, comprising a one-sided conical shape. Thus, the desired shape and geometry of the hollow body 26 is defined by providing a certain number of plies configured in the wall intermediate elements 8. Additionally provided at an arbitrary location in the hollow body as shown in FIG. 8 is a connector (not shown), for example, a blast socket 20, as shown in FIG. 1, or a suitable tube for supplying the hydraulic or pneumatic pressure medium. By increasing the internal high pressure in the hollow body 26, it is furthermore possible, for example, to dilate the upper sheet metal sections 12 in forming them outwards, as indicated by the dot-dash lines in FIG. 8, although, of course, any other location in the hollow body 26 may be further dilated and in being formed to the desired final hollow body contour. For precisely contouring the hollow body 26, it may be inserted in a die and the sheet metal blank 4 made to conform to the contour of the die cavity (not shown) by increasing the internal pressure.

What is claimed is:

1. A method of producing a hollow body (26) from sheet metal, comprising the following steps:

a) providing a flat sheet metal blank (4);

b) folding and/or bending at least one wall intermediate element (8), configured integrally with said sheet metal blank (4), into several superimposed plies;

c) abutting and joining edge portions (16, 18) of said sheet metal blank (4); and d) subjecting said sheet metal blank (4) and said folded wall intermediate element (8) to a pressure medium at an internal high pressure, so that said folded wall intermediate element (8) is freely unfolded to form said hollow body (26).

2. The method as set forth in claim 1, characterized in that after step d) thereof said unfolded wall intermediate element (8) and/or said sheet metal blank (4) is formed by stretching or deep drawing, at an increased internal high pressure, into a desired contour at least sectionwise.

3. The method as set forth in claim 1, characterized in that in the scope of step b) thereof at least one upper and at least one lower sheet metal section (12, 14) of said sheet metal blank (4) are superimposed.

4. The method as set forth in claim 3, characterized in that prior to step d) thereof said superimposed sheet metal sections (12, 14) are joined at least sectionwise by their faces (18).

5. The method as set forth in claim 3, characterized in that at least one spacer (24) is arranged between said superimposed faces (18) of said sheet metal sections (12, 14) which fills out a space between the plies.

6. The method as set forth in claim 3, characterized in that at least one tab-like section is configured at said upper or lower sheet metal section which after step b) is folded to a face (18) of said lower or upper sheet metal section (12, 14) and joined thereto.

7. The method as set forth in claim 1, characterized in that said flat metal blank (4) is produced with a substantially rectangular contour.

8. The method as set forth in claim 1, characterized in that before or after step d) thereof said folded sheet metal blank (4) is inserted into a closeble die adapted to the shape of said hollow body to be produced.

9. The method as set forth in claim 1, characterized in that oil at ambient temperature or heated oil is employed as said pressure medium.

10. A hollow body produced by a method as set forth in claim 1, characterized in that it comprises an axial symmetrical shape.

11. The hollow body as set forth in claim 10, characterized in that it comprises a partially dilated shape.

12. The method as set forth in claim 1, characterized in that step b) further comprises superimposing said edge portions by an overlap.

13. An intermediate product for producing a hollow body (26) of sheet metal, comprising:

a sheet metal blank (4);

at least one wall intermediate element (8) configured integrally with said sheet metal blank (4) and folded and/or bent into several, substantially superimposed plies, and edge portions (16, 18) joined to each other to form said intermediate product (2).

14. The intermediate product as set forth in claim 13, characterized in that it comprises at least one upper and at least one lower sheet metal section (12, 14) arranged substantially parallel one above the other.

15. The intermediate product as set forth in claim 14, characterized in that a fold of said wall intermediate element (8) extends into a portion between said upper and said lower sheet metal section (12, 14).

16. The intermediate product as set forth in claim 14, characterized in that said sheet metal sections (12, 14) are joined to each other at least sectionwise by respective faces (18).

17. The intermediate product as set forth in claim 13, characterized in that at least one spacer (24) is arranged between superimposed faces (18).

18. The intermediate product as set forth in claim 13, characterized in that it is a substantially flat hollow body.

19. The intermediate product as set forth in claim 13, characterized in that it comprises a blast socket (20).

20. The intermediate product of claim 13, characterized in that the sheet metal is selected from the group consisting of aluminum and aluminum alloys.

* * * * *